US006681401B1

(12) United States Patent
Marino

(10) Patent No.: US 6,681,401 B1
(45) Date of Patent: Jan. 27, 2004

(54) BALL GLOVE APPARATUS

(76) Inventor: Robert M. Marino, 3615 Laurel Ridge, Springdale, AR (US) 72764

( * ) Notice: Subject to any disclaimer, the term of this patent is extended or adjusted under 35 U.S.C. 154(b) by 0 days.

(21) Appl. No.: 10/065,932

(22) Filed: Dec. 2, 2002

Related U.S. Application Data

(60) Provisional application No. 60/319,019, filed on Dec. 3, 2001.

(51) Int. Cl.[7] ..... A41D 13/08

(52) U.S. Cl. ..... 2/19

(58) Field of Search ..... 2/16, 19, 20, 159, 2/160, 161.1, 161.6, 163; 602/22

(56) References Cited

U.S. PATENT DOCUMENTS 3,593,803 A * 7/1971 Ibach ..... 172/370
4,295,229 A * 10/1981 Clark et al. ..... 2/20
4,881,275 A * 11/1989 Cazares et al. ..... 2/161.1
5,367,711 A * 11/1994 Calagui ..... 2/161.6
5,628,068 A * 5/1997 DeLong ..... 2/161.1
5,644,796 A * 7/1997 Laughlin ..... 2/161.6
5,970,521 A * 10/1999 Rabbeth ..... 2/161.1
5,991,917 A 11/1999 Kaake
6,308,331 B1 * 10/2001 Robak ..... 2/19

* cited by examiner

*Primary Examiner*—Gary L. Welch
(74) *Attorney, Agent, or Firm*—Christopher L. Parmelee; Walker & Jocke LPA

(57) ABSTRACT

A ball glove such as a baseball or softball glove is provided. The ball glove includes digit stalls extending outwardly from a palm portion of the ball glove. The digit stalls include linkages therein which are adapted to couple with the digits of the human hand. The linkages extend from the digits of the human hand to the ends of the digit stalls. The linkages are operative to provide the digits of a human hand with increased sensitivity to the impact of balls contacting the ends of the ball glove. The ball glove may further include high friction grip portions adjacent the palm side surfaces of the digit stalls for assisting in maintaining a grip on a ball. The ball glove may further include a heel bumper for deflecting a ball traveling outwardly of the glove toward the heel portion of the glove.

30 Claims, 7 Drawing Sheets

BALL GLOVE APPARATUS

TECHNICAL FIELD

This invention relates to ball gloves. Specifically this invention relates to a ball glove with features which improve the ability of a user to feel, catch and manipulate a ball.

BACKGROUND ART

Ball gloves are well known. Common types of ball gloves include baseball gloves and softball gloves which are worn by players on the field of play of a ball game. Ball gloves are found in various sizes and configurations to fit the hands of ball players of all ages and to accommodate different positions of ball players. Ball gloves such as baseball or softball gloves are generally designed to be much larger than a human hand. As a result the digit stalls such as the finger digit stall and the thumb digit stall of a ball glove extend beyond the player's actual fingers and thumb by several centimeters. Ball gloves are generally configured to have a webbing between the finger digit stalls and thumb digit stalls of a ball glove. Ball gloves are designed to move between an open and closed position by ball players moving their thumb digit toward or away from their finger digits. When the ball glove is changed to a closed position, a large pocket is formed which is bounded by the webbing, the digit stalls and a palm portion of the glove. The pocket is used by ball players to capture and secure a ball within the ball glove.

The large size of a typical ball glove relative a player's hand enables the player to catch balls which are out of reach of the actual digits of the hand of the player. Because the tips of the ball glove are not occupied by the player's hand, hard hit balls are often caught in the tips of the ball glove to avoid injury. Unfortunately, because the finger and thumb digits do not extend all the way to the end of the digit stalls of a glove, it is often difficult for a player to feel or sense whether the ball has been securely caught. As a result, players who catch balls in the upper portions of a glove, often must visually look at the glove to verify that they have actually caught the ball.

During the coarse of a game, a player may be required to quickly throw the caught ball to another player. When the ball has been caught in the upper portions of the glove, there is an increased risk that the ball will be dropped due to the player not having a sufficient feel for how securely the ball is caught. Also, when the player collides with the ground, a wall, or another player while catching the ball, the inability to feel the ball caught in the end of the ball glove often increases the opportunity for the ball to be dropped. Consequently there exists a need for a ball glove which provides the player with increases sensitivity to the impact of a ball with the end of the ball glove.

Ball gloves enable a player to more easily catch balls moving through the air at a generally uniform trajectory toward a player. However, many players often have difficulty catching balls that change direction quickly after bouncing up from the ground. Often, the non-uniform surfaces of many ball fields may cause a ball to "take a high hop" which corresponds to the ball bouncing off the field at an unusual and unpredictable angle. When the ball bounces just before the player is able to catch the ball, the player may only have a fraction of a second to adjust the position of the ball glove. If the ball glove is not aligned correctly, the ball may impact the heel of the ball glove and reflect upwardly over the player. Such an occurrence usually results in the ball not being caught and/or fielded in time to make a necessary play. Consequently there exists a need for an improved design of a ball glove which is operative to improve the ability of a ball glove to handle a ball that takes a high hop.

DISCLOSURE OF INVENTION

It is an object of an exemplary form of the present invention to provide a ball glove.

It is a further object of an exemplary form of the present invention to provide a ball glove which may enhance the ability of a ball player to catch a ball.

It is a further object of an exemplary form of the present invention to provide a ball glove which may enhance the ability of a ball player to catch a ball that impacts the glove adjacent the outer digit stalls of the ball glove.

It is a further object of an exemplary form of the present invention to provide a ball glove which may increase a ball player's sensitivity to a ball impacting the outer digit portions of the ball glove.

It is a further object of an exemplary form of the present invention to provide a ball glove which may increase the ball player's ability to manipulate the tips of the glove.

It is a further object of an exemplary form of the present invention to provide a ball glove which can aide in ejecting the ball from the glove during hurried plays.

It is a further object of an exemplary form of the present invention to provide a ball glove which may enhance the ability of a ball player to hold onto a ball after the ball is caught.

It is a further object of an exemplary form of the present invention to provide a ball glove which may enhance the ability of a ball player to handle a ball that takes a high hop.

Further objects of the present invention will be made apparent in the following Best Modes for Carrying Out Invention and the appended claims.

The foregoing objects may be accomplished in an exemplary embodiment by a ball glove that may include linkages. The linkages may include digit couplers that are operative to couple the linkages to the digits of a human hand. Such digit couplers may include rings, openings, straps, bands, and/or other connecting devices which are operative to hold the linkages adjacent the digits of a player's hand. When the hand of the player is inserted into the ball glove, the linkages extend within the digit stalls of a ball glove from the digits of the hand to the ends of the digit stalls. In exemplary embodiments, the linkages may be in generally continuous contact with the fingers of the player. In other embodiments the linkages may be adjacent the fingers of the player but not in continuous contact or not in direct contact. For example, the linkages may be integrated into the walls of the digits stalls of the glove. When a ball contacts the ends or tips of the digit stalls, vibrations, jerks, or any other movement of the linkages caused by the impact of the ball, may be communicated through the linkages to the digits of the player's hand, thereby increasing a player's sensitivity or feeling for the ball.

Further embodiments of the present invention may include friction grip portions adjacent the palm side outer surfaces of the digit stalls. The friction grip portions are operative to further the player's grip and manipulation of the ball. The friction grip portions may include a relatively higher coefficient of friction than adjacent surfaces of the digit stalls. Further embodiments of the friction grip portions may include a plurality of bumps, ridges, or other protrusions which may further reduce slippage of a grip on a ball caught by the ball glove. In other embodiments the linkages may further be in operative connection with the linkages and may provide additional sensitivity to the impact of the ball by the digits of the ball player.

Further embodiments of the present invention may include a heel bumper adjacent the heel of the ball glove that is operative to deflect a ball back into the glove, when the ball takes a high hop adjacent the ball glove. Side edges of the heel bumper may be permanently or releasably connected to the thumb digit stall and the little finger digit stall of the ball glove. The top edge of the heel bumper is orientated to bow away from the palm side of the ball glove body. The heel bumper may be sufficiently flexible to bend inward in response to contact by an inwardly directed ball and may be sufficiently resilient to automatically return to the original outwardly bowed orientation after the impact of the ball.

BEST MODES FOR CARRYING OUT INVENTION

Figure 1:
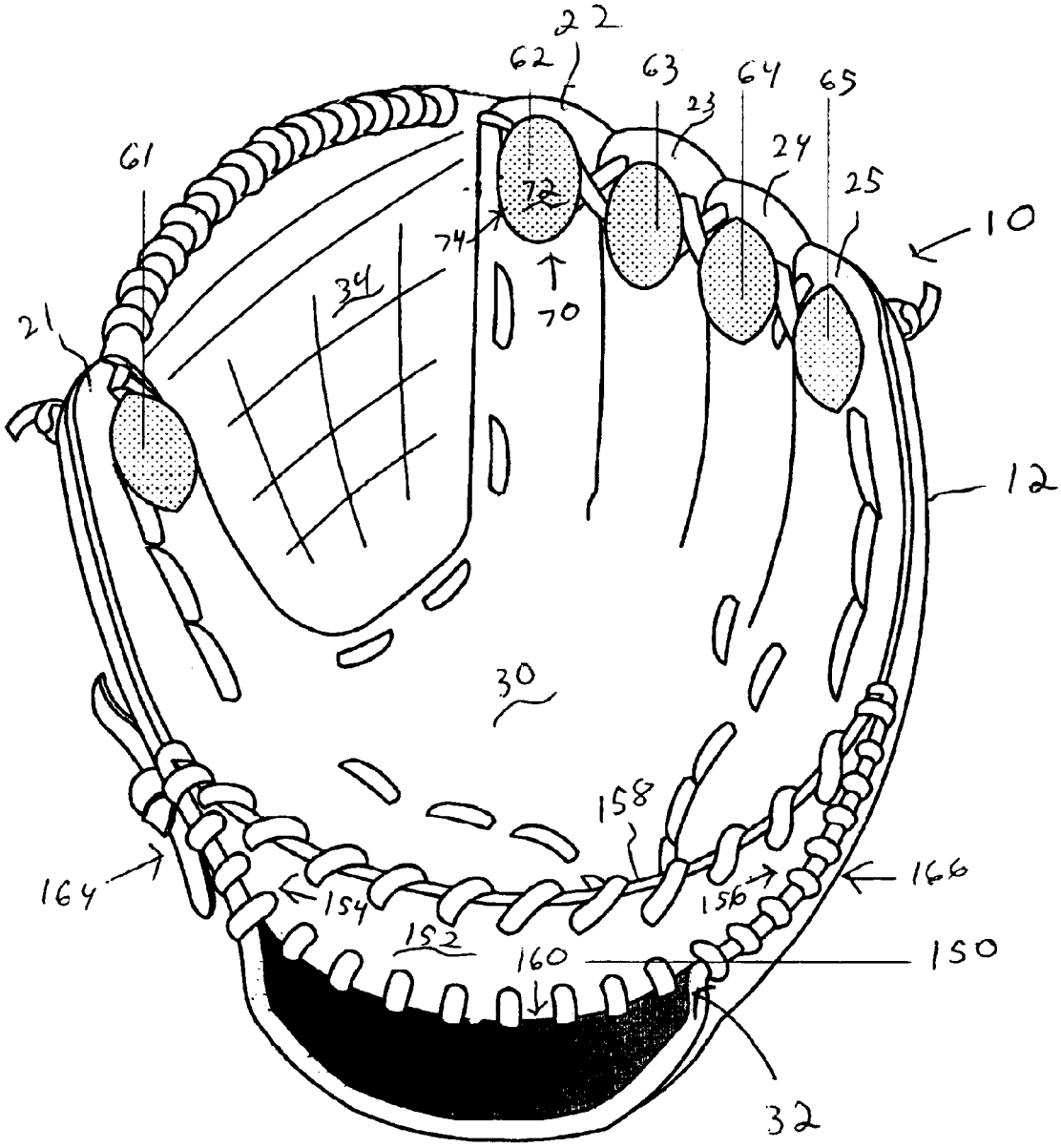
FIG. 1 is a perspective view representative of an embodiment of a ball glove incorporating features of the present invention.

Referring now to the drawings and particularly to FIG. 1, there is shown therein a perspective view of an embodiment of a ball glove 10 including certain features of the present invention. The ball glove 10 includes a ball glove body 12. The glove body 12 may be comprised of a natural or synthetic leather or any other material that may be used in constructing a body of a baseball or softball glove. For example, embodiments of the glove body may also be comprised of a woven, molded, or extruded material which is sufficiently flexible to enable a ball player to open and close the glove to catch a ball.

The ball glove body includes a plurality of digit stalls 21–25. As used herein and in the claims, a digit is defined as the thumb or finger of a human hand and a digit stall of a ball glove is defined as the portion of a glove that receives a thumb digit or finger digit of a human hand therein when the glove is placed around the hand of the player.

The ball glove body further includes a palm portion 30 which corresponds to the portion of the ball glove body that is adjacent the palm of the ball player's hand. The ball glove also includes a heel portion 32. The heel portion 32 is located on the palm side of the glove body and is between the palm portion 30 and the wrist of the ball player's hand. In addition the ball glove body may further include a webbing 34 between at least the thumb digit stall 21 and the index finger stall 22. In alternative embodiments the webbing may extend between the other digits 22–25 as well.

Figure 2:
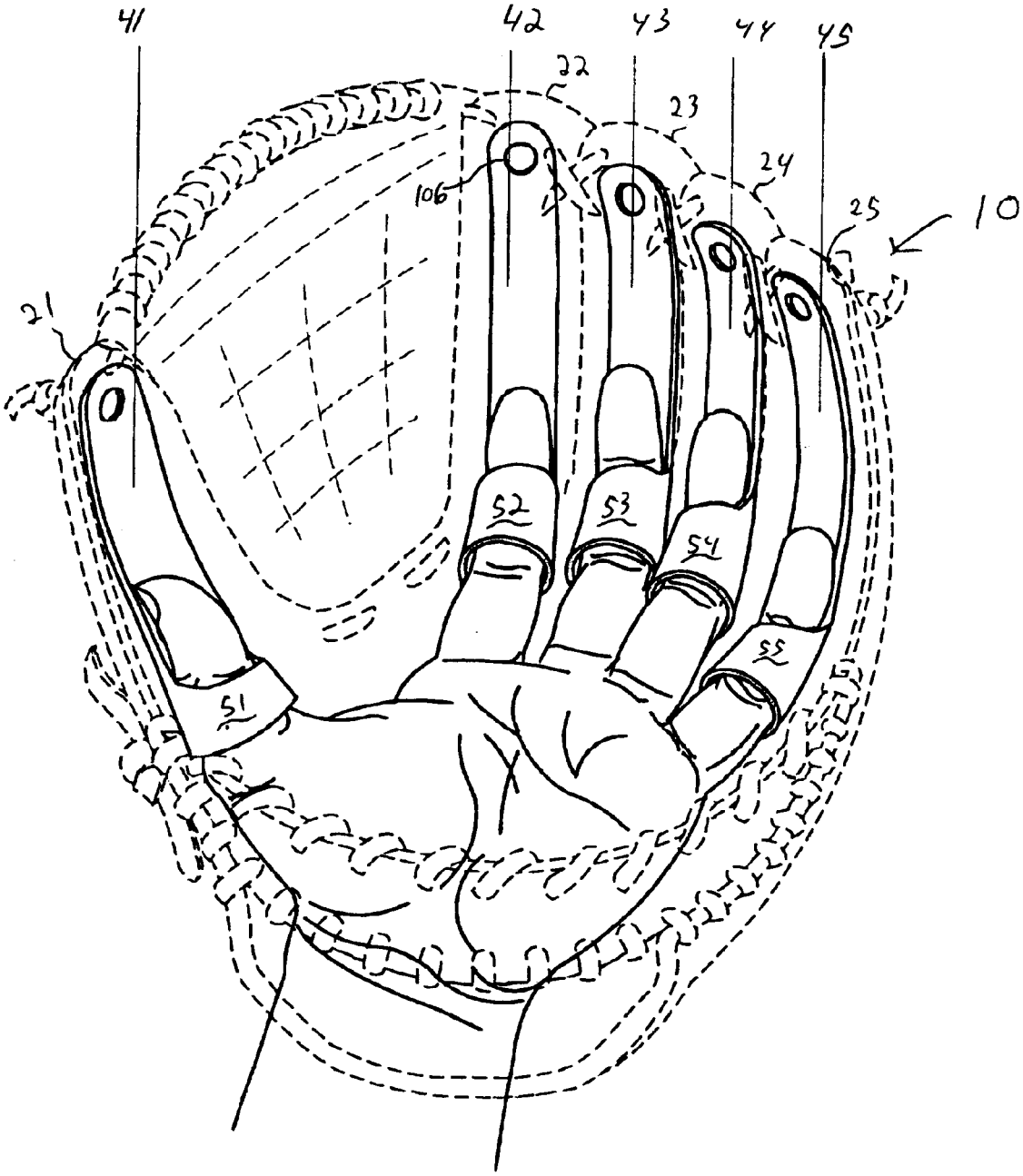
FIG. 2 is an interior view of the ball glove showing a plurality of linkages within digit stalls of the ball glove.

FIG. 2 shows an interior view of the ball glove 10. As shown in FIG. 2, the ball glove 10 may include a plurality of linkages 41–45 which extend inside the digit stalls 21–25 respectively. In this described embodiment, the linkages may extend from the digits of a hand of a player to the upper ends of the inside cavity of the digit stalls. In an exemplary embodiment, the linkages may include digit couplers 51–55. The digit couplers provide means for coupling the linkages to the digits of the player's hand or provide a means for positioning the linkages in close proximity to the digits of the player's hand. Such digit couplers may include for example rings, clips, bands, straps, and/or other connecting devices with sufficient size to secure the linkages to the digits of the player's hand. The digit couplers may enable the linkages to generally remain in physical contact with the digits of the player's hand so that the impact of a ball with the ends of the linkages may be mechanically communicated to the digits of the player's hand, and so that the digits of the player's hand may manipulate the digit stalls to help catch, grip, and eject the ball.

Figure 7:
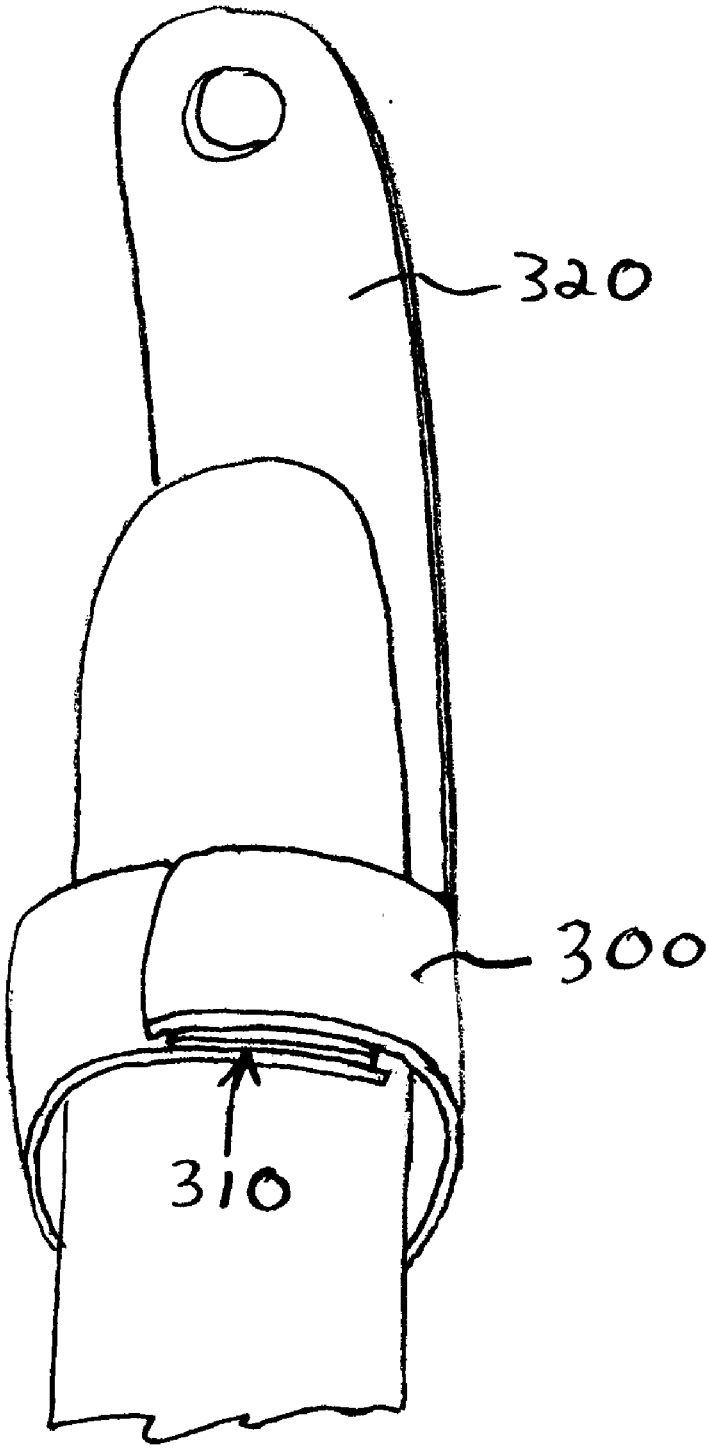
FIG. 7, shows an alternative embodiment of a linkage with a digit coupler that includes a "hook and loop fastener" such as Velcro.

In an embodiment, the digits of the player may be inserted through the opening in the digit couplers of the linkages when the digits are moved into the digit stalls of the glove. In further embodiments, the present invention may include a ball glove method in which the linkages are individually coupled to the digits of a player's hand before the hand is inserted into the glove body. For digit couplers that include rings, the digits of a player's hand may be slid into or through the rings. In embodiments of the digit couplers which include bands, the bands may be strapped around the digits of the player's hand and secured in place. As shown in FIG. 7, in an embodiment the digit couplers 300 may include hook and loop fasteners 310 such as Velcro, an adhesive tape or any other fastener that is operative to removably couple the linkages 320 to the digits of a player's hand.

Figure 6:
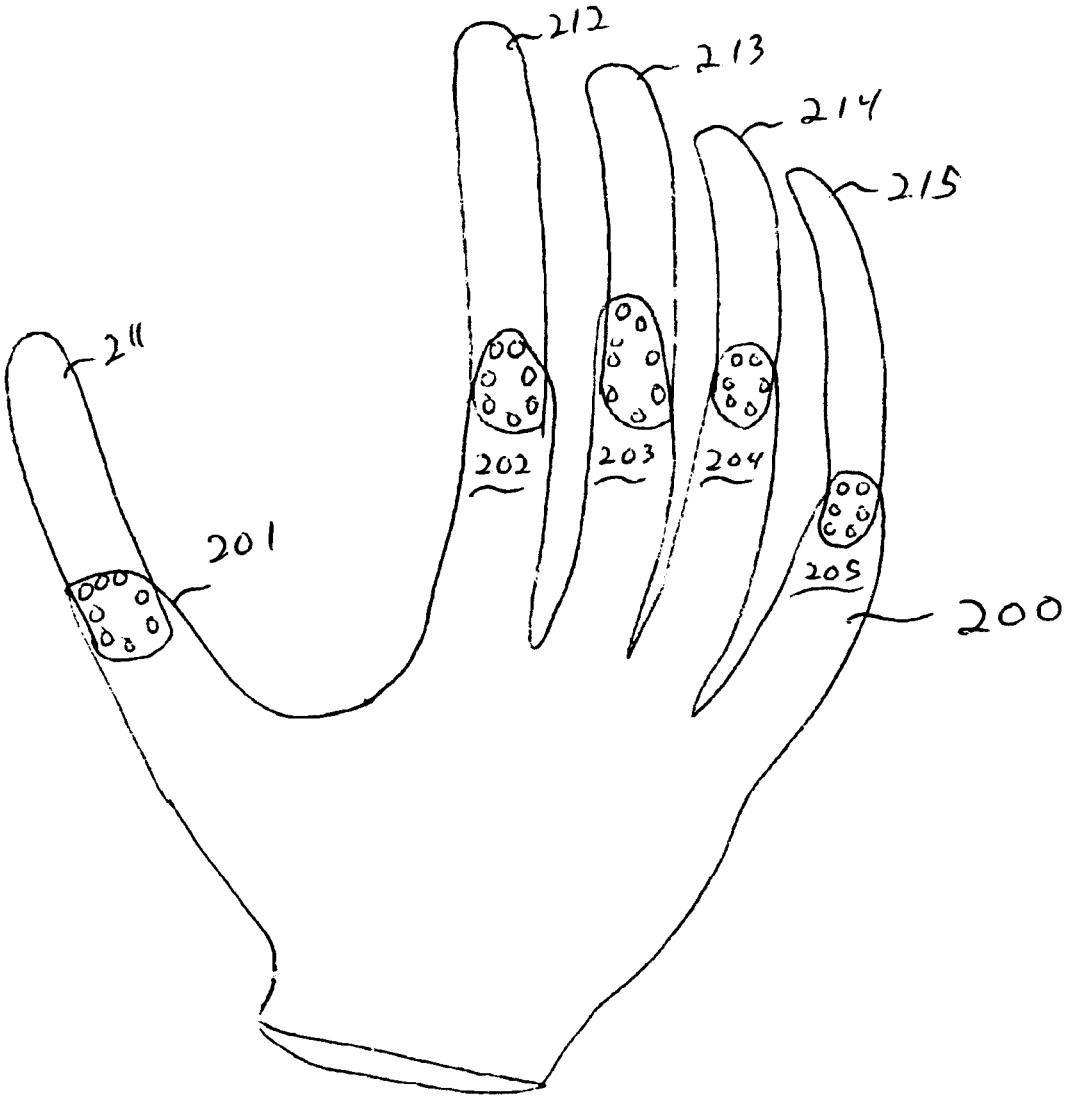
FIG. 6 is a side perspective view of a thin glove with linkages attached thereto.

In further embodiments the digit couplers may include the digit stalls of a further glove, with the linkages sewn into the further glove and extending above the digits stalls. Such a further glove may be comprised of a relatively thin flexible material to have a construction similar to a batting glove. FIG. 6, shows an example of such a further glove 200. Here the linkages 211–215 are in generally fixed connection with the tips of the digit stalls 201–205 of the further. The further glove 200 with attached linkages, may be placed over the player's hand before the hand is inserted into a ball glove.

In these described embodiments the linkages may increase the ball player's ability to sense the impact of a ball contacting the ends of the digit stalls of the ball glove. When a ball hits the ends of the digit stalls of the ball glove, the resulting impact may be operative to communicate mechanical forces through one or more linkages to the digits of the player coupled to the linkages and/or in a "snug" association adjacent the digits of the player's hand. For example, such impact forces may cause the linkages to change position relative to other linkages and/or relative the glove body or digit stalls of the glove body. Such impact forces may also produce a pulse, vibration, and/or jerk in the linkages. In addition, the linkages may be operative to bend, flex, and/or compress in response to the impact of a ball. Such pulses, vibrations, jerks, bends, flexes, compressions and/or any other movement of the linkages caused by the impact of the ball may be felt by the digits of the hand of the player and enable the player to have increased sensitivity to the impact of the ball adjacent the tips of the digit stalls and allow the player to better manipulate the areas of the glove that the player's hand does not occupy.

The additional sensation in a player's digits caused by the linkages may enable the player to determine how to guide the ball into the glove as well as how best to hold onto the ball during collisions with the ground, a wall, or another player as well as manipulate and eject the ball. In an embodiment, the linkages may be comprised of a generally rigid material such as an impact resistant plastic. In alterative embodiments the linkages may be comprised of other materials that may be either rigid or may be operative to flex or deform responsive to the impact of the ball adjacent the linkages.

In embodiments, the linkages may be integrated into the ball glove with generally permanent connectors such as through stitching, lacing, riveting, or any other generally secure connection. Embodiments may also include a snug friction fit between the linkages and the digits stalls. The linkages may also be in removable connection with the ball glove and may be coupled to the digits of a player's hand either inside or outside the stalls of the ball glove. For example, as discussed previously, the linkages may be attached to a further glove which is placed over the ball player's hand before the hand is inserted into the ball glove.

Referring back to FIG. 1, further embodiments of the ball glove 10 may include friction grip portions 61–65, positioned on the palm side surfaces of one or more digit stalls 21–25 of the ball glove. The friction grip portions 61–65 may have generally high friction non-slip surfaces and may extend outwardly from the surfaces of the digit stalls. The friction grip portion may have a generally convex shape. However, alternative embodiments of the friction grip portions may include a generally flat or a generally concave shape. The friction grip portions provide a means for gripping a ball with the digit stalls of the ball glove. The friction grip portions may further prevent balls from sliding out of the glove body when the glove is folded to a closed position. The contour, shape of the frictions grips may allow them to serve as artificial fingertips which assist in grabbing, holding, and manipulating a ball.

As shown with reference to the index finger stall 22, the friction grip portion 62 may include an outer palm side surface 72 connected adjacent the outer palm side surfaces 70 of the digit stall 22. The outer surfaces of the friction grip portions may be comprised of materials that assist in gripping a ball and/or are operative to reduce slippage of the ball adjacent the friction grip portions. Such materials may have rough uneven surfaces. Such materials may further include a plurality of projections 74 such as bumps, ridges, teeth or other protrusions which reduce the opportunity for a ball to slip out of the grip of the glove. In addition the friction grip portions may be comprised of materials which have spongy or tacky properties. For example, in such an embodiment, the friction grip portions may be comprised of a deformable and resilient natural or synthetic rubber material with a plurality of bumps or ridges. In embodiments, the outer surfaces of the friction grip portions may have a higher coefficient of static and/or kinetic friction than adjacent outer surfaces of the digit stalls.

Figure 3:
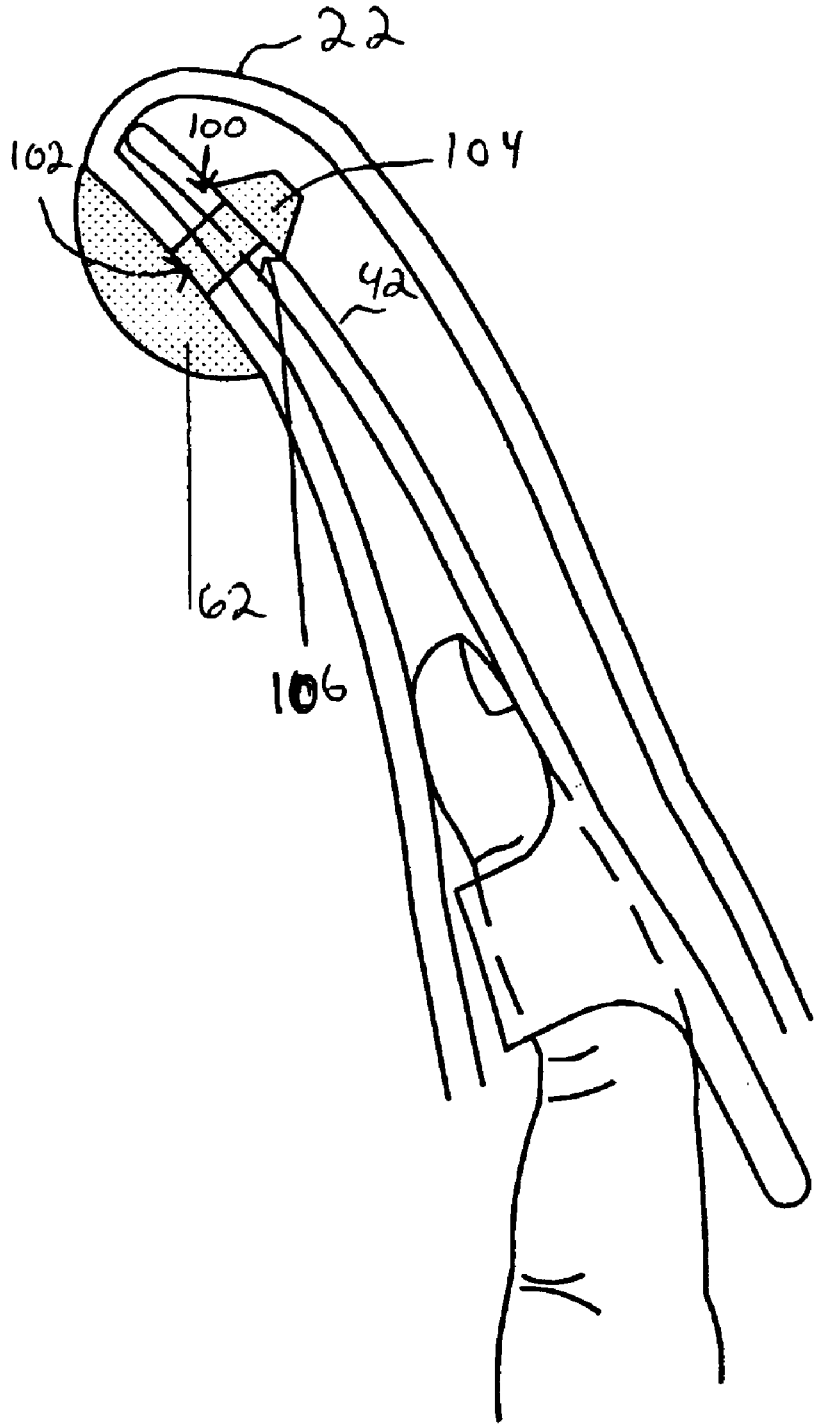
FIG. 3 is a cross-sectional view of a digit stall of the ball glove.

In embodiments of the ball glove which include friction grip portions, the linkages may or may not be connected to the friction grip portions. For example as shown in FIG. 3, the linkages may be connected to the friction grip portions through the walls of the digit stalls. FIG. 3 shows a side cross-sectional view of the index finger digit stall 22. Here the glove may include linkage/grip connectors 100 which provide a means for coupling the linkage 42 to the friction grip portion 62 of the digit stall 22. For example in an embodiment, the digit stall may include an aperture 102. The linkage/grip connectors may correspond to a prong 104 of the friction grip portion 62 that is operative to pass through the aperture 102 of the wall of the digit stall 22 and connect to the linkage 42. The linkage may include an aperture 106 or other coupling adapter that is operative to cooperatively receive the prong. In alternative embodiments, the linkage may include a prong which may be cooperatively received by an aperture or other coupling adapter of the friction grip portion. In other embodiments the linkage/grip connector may include stitching. As used herein the linkage/grip connector corresponds to any connector or fastening device that is operative to mechanically couple linkages within a digit stall to a friction grip portion adjacent an outside surface of the digit stall.

Figure 4:
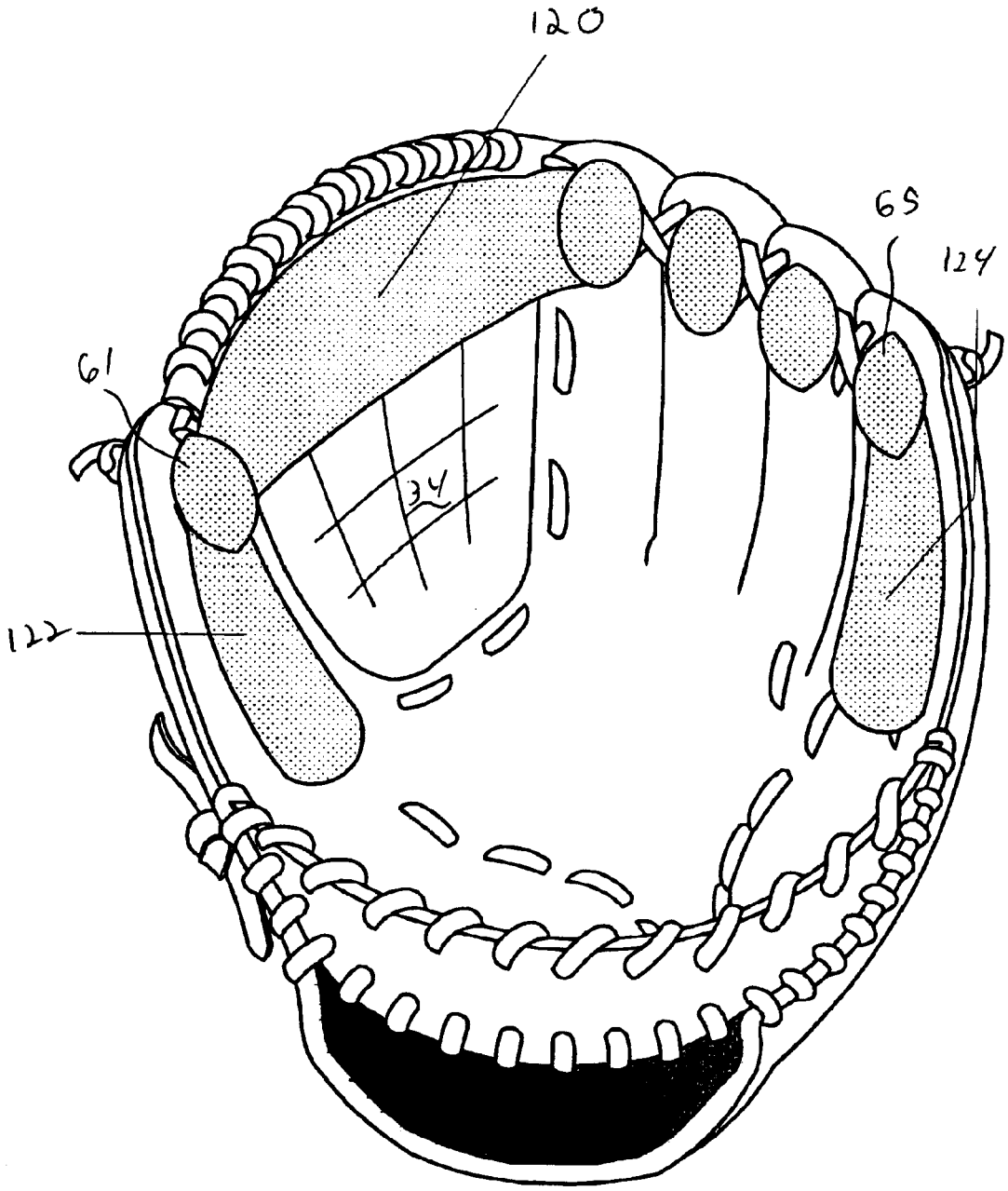
FIG. 4 is a perspective view representative of an alternative embodiment of a ball glove incorporating features of the present invention.

In an embodiment the friction grip portions may be positioned on the palm side of the tips or ends of the digit stalls such that the generally convex shape of an embodiment of the friction grip portions extends outwardly from the digit stalls in a direction that is generally transverse with respect to the longitudinal axis of the linkages. In addition to the friction grip portions being comprised of high friction materials, other portions of the ball glove may also include surfaces with a coefficient of static or kinetic friction which is higher than adjacent portions of the digit stalls and/or palm portion of the ball glove. For example as shown in FIG. 4, the webbing 34 may include a further friction grip portion 120 with a high friction surface. In addition lower portions 122, 124 of one or more digit stalls may include further friction grip portions.

Referring back to FIG. 1, embodiments of the present invention may include a ball glove 10 with a heel bumper 150. The heel bumper 150 provides a means for deflecting a ball directed outwardly from the ball glove. For example, when a ball takes a "high hop" the heel bumper of an embodiment of the present invention may deflect the ball downwardly, so that the ball does not travel upward adjacent the upper body of the ball player. The heel bumper 150 includes a flexible wall 152 that extends across the heel portion 32 of the ball glove between opposed sides of the ball glove. Opposed side edges 154, 156 of the heel bumper 150 are in operative connection with the sides 164, 166 of the ball glove body adjacent the thumb digit stall 21 and the little finger digit stall 25 of the ball glove. In one embodiment, the bottom edge 160 of the heel bumper may be in operative connection with the heel portion 32 of the ball glove. However, in alternative embodiments the bottom edge 160 of the heel bumper may not be in operative connection with the heel portion 32 of the ball glove. When the heel bumper is not connected to the heel portion of the glove body, the opening bounded by the heel portion 32 of the ball glove and the bottom edge 160 of the heel bumper may be sufficiently narrow to prevent a ball from passing therethrough.

Figure 5:
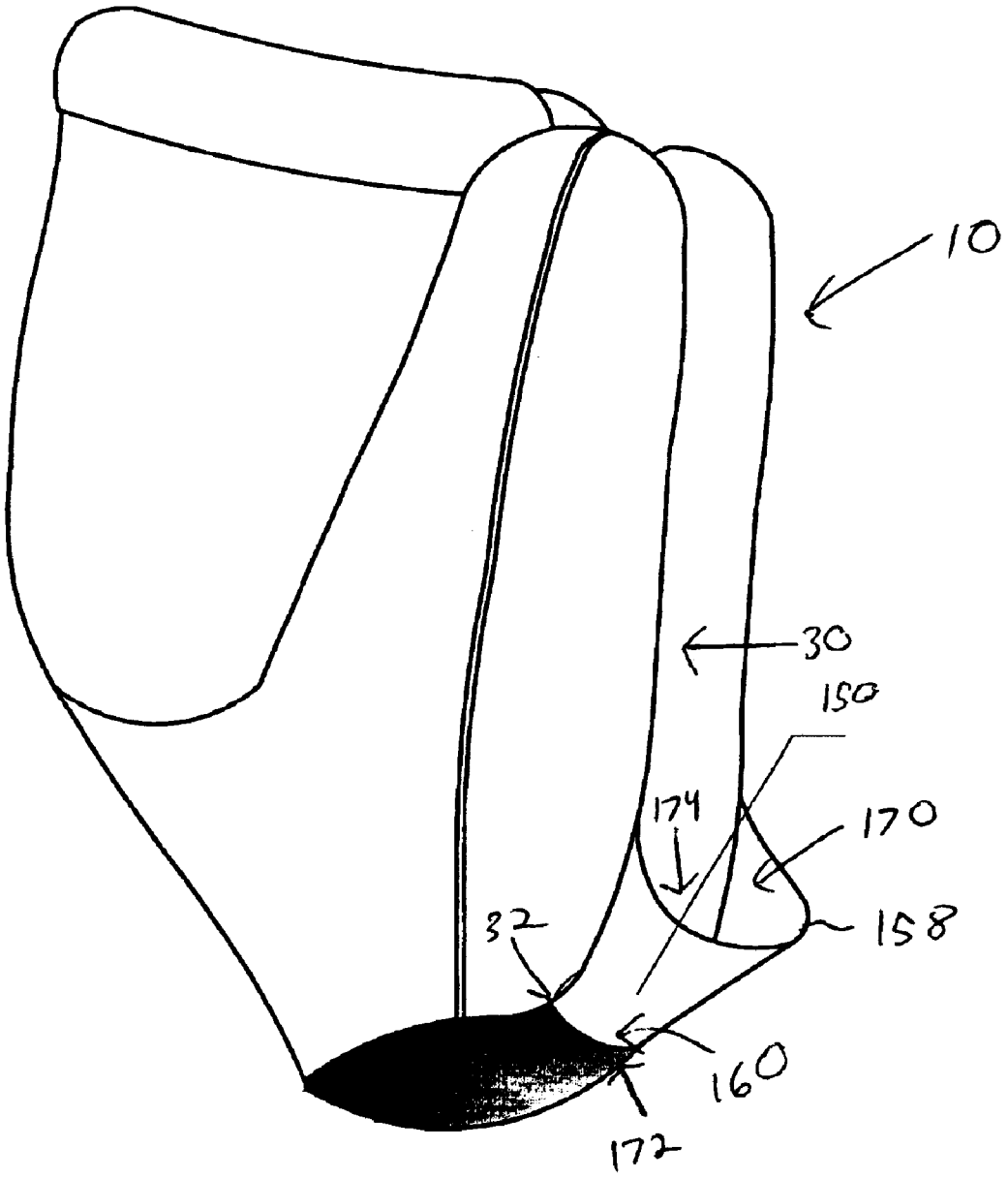
FIG. 5 is a side view representative of the ball glove.

As shown in FIG. 5, when a glove is folded into a closed position, the top edge 158 of the heel bumper 150 bows further outward from the glove body by several centimeters, thereby creating a top opening 170 to a shallow pocket 174. In one embodiment the distance between the bottom edge 160 and top edge 158 of the heel bumper at the middle of the heel portion of the ball glove may be less than the diameter of a baseball.

In one embodiment, the heel bumper may be comprised of a sufficiently strong material to be operative to reflect a ball impacting the inside wall surface of the heel bumper. In addition, the heel bumper may be comprised of a sufficiently flexible material to enable the top edge of the heel bumper to bend inward in response to an inwardly directed ball impacting the outside wall surface of the heel bumper. By bending inward in such cases, the heel bumper reduces the opportunity for a ball impacting the outside wall of the heel bumper to deflect away from the glove. In embodiments, the heel bumper may be comprised of the same material as the body of the ball glove. For example the heel bumper may be comprised of a natural or synthetic leather. In alternative embodiments, the heel bumper may be comprised of other flexible materials that enable the top edge of the heel bumper to bend inward and automatically return to a generally outwardly bowed position.

In some embodiments, the heel bumper may be integrated into the body of the glove with stitching, lacing, rivets, glue or any other generally permanent connectors between the heel bumper and the ball glove body. However, in alternative embodiments, the heel bumper may be in removable connection with the ball glove body with the use of generally releasable connectors such as velcro snaps, and buttons between the heel bumper and the ball glove body.

Thus embodiments of the new ball glove described herein achieve one or more of the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

What is claimed is:

1. A ball glove comprising:

a ball glove body, wherein the ball glove body is adapted to receive a human hand therein, wherein the ball glove body includes:

a palm portion;

a plurality of digit stalls extending outwardly from the palm portion, wherein the digit stalls are operative to receive a plurality of digits of the human hand; and a webbing in operative connection between at least two of the digit stalls; and at least one linkage, wherein the at least one linkage includes a digit coupler, wherein the digit coupler is adapted to releasably connect the at least one linkage to the at least one digit of the human hand, wherein the digit coupler includes an aperture with sufficient size to receive the at least one digit of the human hand therethrough, wherein the at least one linkage is adapted to extend within at least one of the digit stalls between the at least one digit of the human hand and an end of the at least one of the digit stalls.

2. The ball glove according to claim 1, further comprising a plurality of linkages, wherein each of the digit stalls includes one of the linkages therein.

3. The ball glove according to claim 2, wherein the linkages are in removable connection with the digit stalls.

4. The ball glove according to claim 2, wherein the linkages are in fixed connection with at least one portion of the digit stalls.

5. The ball glove according to claim 4, further comprising a friction grip portion in operative connection with each of the linkages, wherein each of the friction grip portions extends adjacent a palm side outer surface of the digit stalls.

6. The ball glove according to claim 5, wherein the friction grip portions include an outer surface with a coefficient of friction which is higher than a coefficient of friction of the palm side outer surfaces of the digit stalls adjacent the friction grip portions.

7. The ball glove according to claim 1, further comprising a plurality of linkages and a further glove in removable connection with the digit stalls, wherein the further glove includes a plurality of digit stalls, wherein the linkages are in operative connection with the digit stalls of the further glove.

8. The ball glove according to claim 1, further comprising at least one friction grip portion in operative connection with the at least one of the digit stalls, wherein the at least one friction grip portion extends outwardly from a palm side surface of the at least one of the digit stalls.

9. The ball glove according to claim 8, wherein the at least one of the digit stalls includes an aperture in a wall of the at least one of the digit stalls, wherein the at least one linkage is in operative connection with the at least one friction grip portion through the aperture in the wall of the at least one of the digit stalls.

10. The ball glove according to claim 9, wherein the at least one friction grip portion includes a prong, wherein the prong extends through the aperture of the at least one of the digit stalls, wherein the at least one linkage is adapted to cooperatively receive the prong.

11. The ball glove according to claim 9, wherein the at least one linkage includes a prong, wherein the prong extends through the aperture of the at least one of the digit stalls, wherein the at least one friction grip is adapted to cooperatively receive the prong.

12. The ball glove according to claim 9, wherein the at least one friction grip includes a generally convex contour, wherein the friction grip extends outwardly from the palm side surface of the at least one of the digit stalls in a direction that is generally transverse with respect to the longitudinal axis of the at least one linkage within the at least one of the digit stalls.

13. The ball glove according to claim 8, wherein the friction grip portion includes a friction grip surface with a higher coefficient of friction than the palm side surface of the at least one of the digit stalls.

14. The ball glove according to claim 1, further comprising a heel bumper, wherein the heel bumper includes a first side edge, a second side edge, a top edge, a bottom edge, an inner wall surface, and an outer wall surface, wherein the ball glove body includes a heel portion adjacent the palm portion, wherein the plurality of digit stalls include a thumb digit stall and a little finger digit stall, wherein, the first side edge of the heel bumper is in operative connection with the ball glove body adjacent the thumb digit stall, wherein the second side edge of the heel bumper is in operative connection with the ball glove body adjacent the little finger digit stall, wherein the top edge of the heel bumper is operative to bow outwardly from the heel portion, wherein the heel bumper is operative to deflect a ball impacting the inner wall surface of the heel bumper, wherein the heel bumper is operative to bend inwardly responsive to a ball impacting the outer wall surface of the heel bumper, wherein the heel bumper is sufficiently resilient to automatically return to an original outwardly bowed orientation after being bended inwardly responsive to the ball impacting the outer wall surface of the heel bumper.

15. The ball glove according to claim 14, wherein the bottom edge of the heel bumper is in operative connection with the heel portion of the ball glove.

16. The ball glove according to claim 14, wherein the distance between the top edge and bottom edge of the heel bumper adjacent a middle of the heel portion is less than the diameter of a baseball.

17. A ball glove comprising:

a ball glove body, wherein the ball glove body is adapted to receive a human hand therein, wherein the ball glove body includes:

a palm portion;

a plurality of digit stalls extending outwardly from the palm portion, wherein the digit stalls are operative to receive a plurality of digits of the human hand;

at least one friction grip portion in operative connection with at least one of the digit stalls, wherein the at least one friction grip portion extends outwardly from a palm side surface of the at least one of the digit stalls, wherein the at least one of the digit stalls includes an aperture in a wall of the at least one of the digit stalls, wherein the at least one friction grip portion includes a prong, wherein the prong extends through the aperture of the at least one of the digit stalls; and a webbing in operative connection between at least two of the digit stalls; and at least one linkage, wherein the at least one linkage is adapted to extend within at least one of the digit stalls between the at least one digit of the human hand and an end of the at least one of the digit stalls, wherein the at least one linkage is in operative connection with the at least one friction grip portion through the aperture in the wall of the at least one of the digit stalls, wherein the at least one linkage is adapted to cooperatively receive the prong, wherein the at least one linkage includes an aperture that is operative to receive the prong therethrough.

18. A ball glove comprising:

a ball glove body, wherein the ball glove body is adapted to receive a human hand therein, wherein the ball glove body includes:

a palm portion;

a plurality of digit stalls extending outwardly from the palm portion, wherein the digit stalls are operative to receive a plurality of digits of the human hand;

at least one friction grip portion in operative connection with at least one of the digit stalls, wherein the at least one friction grip portion extends outwardly from a palm side surface of the at least one of the digit stalls, wherein the friction grip portion includes a friction grip surface with a higher coefficient of friction than the palm side surface of the at least one of the digit stalls, wherein the friction grip surface includes a plurality of projections; and a webbing in operative connection between at least two of the digit stalls; and at least one linkage, wherein the at least one linkage is adapted to extend within at least one of the digit stalls between the at least one digit of the human hand and an end of the at least one of the digit stalls.

19. The ball glove according to claim 18, wherein the plurality of digit stalls includes a thumb digit stall and an index finger digit stall, wherein a portion of the webbing between the thumb digit stall and the index finger digit stall includes a further friction grip portion, wherein the further friction grip portion includes a coefficient of friction higher than a palm side surface of the thumb digit stall and the palm side surface of the index finger digit stall.

20. A ball glove comprising:

a ball glove body, wherein the ball glove body includes a plurality digit stalls adapted to receive the digits of a human hand, wherein the ball glove body includes a heel portion and a palm portion;

a means for deflecting a ball, wherein the deflecting means is in operative connection with the ball glove body adjacent the heel portion of the ball glove body, wherein the deflecting means is operative to deflect a ball impacting an interior wall of the deflecting means, wherein the deflecting means is operative to bend inwardly toward the palm portion of the ball glove body responsive to a ball contacting an outside wall of the deflecting means, wherein the deflecting means is sufficiently resilient to automatically return to an outwardly bowed position after bending inwardly; and a plurality of linkages, wherein the linkages are adapted to extend within the digit stalls of the ball glove, wherein each linkage includes a means for coupling each linkage to a digit of a human hand.

21. The ball glove according to claim 20 further comprising:

at least two means for gripping a ball, wherein the at least two gripping means are in operative connection with tips of at least two of the digit stalls, wherein the at least two gripping means extend adjacent palm side surfaces of the at least two digit stalls.

22. The ball glove according to claim 21, further comprising:

a means for coupling each linkage to one of the means for gripping.

23. A ball glove method comprising:

a) placing a plurality of digits of a human hand through rings of a plurality of linkages to couple the plurality of linkages to the plurality of digits of the human hand, wherein the linkages extend beyond the tips of the digits of the human hand; and b) placing the human hand into a ball glove, wherein both the linkages and the digits of the human hand extend into digit stalls of the ball glove, wherein the linkages extend from the digits of the human hand to adjacent the closed ends of the digit stalls.

24. The method according to claim 23, wherein in step (a) the rings are comprised of bands, wherein step (a) includes strapping the bands around the digits of the human hand.

25. The method according to claim 24, wherein in step (a) the bands include hook and loop fasteners.

26. The method according to claim 23, wherein the linkages are in operative connection with a further glove, wherein step (a) includes inserting the hand into the further glove, wherein step (b) includes inserting the hand with the further glove thereon into the ball glove.

27. A ball glove comprising:

a ball glove body, wherein the ball glove body is adapted to receive a human hand therein, wherein the ball glove body includes:

a palm portion;

a plurality of digit stalls extending outwardly from the palm portion, wherein the digit stalls are operative to receive a plurality of digits of the human hand, wherein the plurality of digit stalls include a thumb digit stall and a little finger digit stall; and a webbing in operative connection between at least two of the digit stalls; and a heel bumper, wherein the heel bumper includes a first side edge, a second side edge, a top edge, a bottom edge, an inner wall surface, and an outer wall surface, wherein the ball glove body includes a heel portion adjacent the palm portion, wherein, the first side edge of the heel bumper is in operative connection with the ball glove body adjacent the thumb digit stall, wherein the second side edge of the heel bumper is in operative connection with the ball glove body adjacent the little finger digit stall, wherein the top edge of the heel bumper is operative to bow outwardly from the heel portion, wherein the heel bumper is sufficiently stiff to deflect a ball impacting the inner wall surface of the heel bumper, wherein the heel bumper is operative to bend inwardly responsive to a ball impacting the outer wall surface of the heel bumper, wherein the heel bumper is sufficiently resilient to automatically return to an original outwardly bowed orientation after being bended inwardly responsive to the ball impacting the outer wall surface of the heel bumper; and at least one linkage, wherein the at least one linkage includes a digit coupler, wherein the digit coupler is adapted to releasably connect the at least one linkage to the at least one digit of the human hand, wherein the digit coupler includes an aperture with sufficient size to receive the at least one digit of the human hand therethrough, wherein the at least one linkage is adapted to extend within at least one of the digit stalls between the at least one digit of the human hand and an end of the at least one of the digit stalls.

28. The ball glove according to claim 27, wherein the bottom edge of the heel bumper is in operative connection with the heel portion of the ball glove.

29. The ball glove according to claim 27, wherein the bottom edge of the heel bumper is not connected with the heel portion of the ball glove.

30. The ball glove according to claim 27, wherein the distance between the top edge and bottom edge of the heel bumper adjacent a middle of the heel portion is less than the diameter of a baseball.

* * * * *